US011959219B2

(12) United States Patent
Jung et al.

(10) Patent No.: US 11,959,219 B2
(45) Date of Patent: Apr. 16, 2024

(54) WASHING AGENT PUMP AND LAUNDRY TREATING APPARATUS HAVING THE SAME

(71) Applicant: LG ELECTRONICS INC., Seoul (KR)

(72) Inventors: Sungwoon Jung, Seoul (KR); Hunjun Jang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/882,020

(22) Filed: Aug. 5, 2022

(65) Prior Publication Data

US 2022/0372689 A1 Nov. 24, 2022

Related U.S. Application Data

(60) Continuation of application No. 16/855,431, filed on Apr. 22, 2020, now Pat. No. 11,525,205, which is a (Continued)

(30) Foreign Application Priority Data

Jan. 5, 2016 (KR) ..... 10-2016-0001255

(51) Int. Cl.
*D06F 39/02* (2006.01)
*D06F 23/02* (2006.01)
(Continued)

(52) U.S. Cl.
CPC ..... *D06F 39/022* (2013.01); *D06F 23/02* (2013.01); *D06F 33/37* (2020.02); *D06F 37/22* (2013.01);
(Continued)

(58) Field of Classification Search
CPC ..... D06F 39/022; D06F 39/04; D06F 39/028; D06F 39/085; D06F 39/10; D06F 39/14;
(Continued)

(56) References Cited

U.S. PATENT DOCUMENTS 10,081,901 B2 9/2018 Jo et al.
10,711,385 B2 7/2020 Kim et al.
(Continued)

FOREIGN PATENT DOCUMENTS

CN 101631908 1/2010
CN 102587090 7/2012
(Continued)

OTHER PUBLICATIONS

KR20130022792A—machine translation (Year: 2013).*
(Continued)

*Primary Examiner* — Tinsae B Ayalew
(74) *Attorney, Agent, or Firm* — KED & ASSOCIATES, LLP

(57) ABSTRACT

Provided is a washing agent pump and a laundry treating apparatus having the same. The laundry treating apparatus may include a cabinet, a tub provided within the cabinet, a rotary tub provided within the tub in a rotatable manner, and a washing agent supply unit. The washing agent supply unit may include a storage container to store a liquid washing agent including a liquid detergent or a liquid softener, the storage container being slidably provided in the cabinet, a washing agent supply passage having one side connected to the storage container and another side connected to the tub, and a washing agent delivery device provided in the washing agent supply passage to deliver the liquid washing agent to the tub.

21 Claims, 12 Drawing Sheets

Related U.S. Application Data division of application No. 16/252,011, filed on Jan. 18, 2019, now Pat. No. 11,078,618, which is a division of application No. 15/392,052, filed on Dec. 28, 2016, now Pat. No. 10,378,139.

(51) Int. Cl.

| | |
|---|---|
| ***D06F 33/37*** | (2020.01) |
| ***D06F 37/22*** | (2006.01) |
| ***D06F 39/04*** | (2006.01) |
| ***F04B 13/02*** | (2006.01) |
| ***F04B 49/02*** | (2006.01) |
| ***F04B 49/10*** | (2006.01) |
| *D06F 34/14* | (2020.01) |
| *D06F 39/08* | (2006.01) |
| *D06F 39/10* | (2006.01) |
| *D06F 39/14* | (2006.01) |
| *F04B 17/03* | (2006.01) |
| *F04B 19/22* | (2006.01) |

(52) U.S. Cl.

CPC ..... *D06F 39/04* (2013.01); *F04B 13/02* (2013.01); *F04B 49/02* (2013.01); *F04B 49/106* (2013.01); *D06F 34/14* (2020.02); *D06F 39/028* (2013.01); *D06F 39/085* (2013.01); *D06F 39/10* (2013.01); *D06F 39/14* (2013.01); *F04B 17/03* (2013.01); *F04B 19/22* (2013.01); *F04B 2205/09* (2013.01)

(58) Field of Classification Search

CPC ..... D06F 33/37; D06F 23/02; D06F 37/22; F04B 13/02; F04B 49/02; F04B 49/106; F04B 17/03; F04B 19/22; F04B 2205/09

USPC ..... 68/17 R

See application file for complete search history.

(56) References Cited

U.S. PATENT DOCUMENTS

| | | | |
|---|---|---|---|
| 2008/0202173 | A1 | 9/2008 | Kim et al. |
| 2012/0096901 | A1 | 4/2012 | Zattin et al. |
| 2014/0075684 | A1 | 3/2014 | Kim et al. |
| 2015/0048109 | A1 | 2/2015 | Wang et al. |
| 2016/0186370 | A1 | 6/2016 | Kim et al. |

FOREIGN PATENT DOCUMENTS

| | | |
|---|---|---|
| CN | 202644207 | 1/2013 |
| CN | 103866537 | 6/2014 |
| CN | 104641031 | 5/2015 |
| CN | 105358757 | 2/2016 |
| EP | 1 939 347 | 7/2008 |
| EP | 2 708 633 | 3/2014 |
| EP | 2708633 | 3/2014 |
| EP | 2 829 649 | 1/2015 |
| EP | 3 190 293 | 1/2015 |
| JP | 2011-200519 | 10/2011 |
| JP | 2013-099400 | 5/2013 |
| JP | 2015-532842 | 11/2015 |
| KR | 10-2008-0079474 | 9/2008 |
| KR | 10-2010-0081255 | 7/2010 |
| KR | 10-2012-0004208 | 1/2012 |
| KR | 10-2013-0022792 | 3/2013 |
| KR | 10-1320203 | 10/2013 |
| KR | 10-2014-0065858 | 5/2014 |
| KR | 10-2015-0004741 | 1/2015 |
| KR | 10-2015-0006260 | 1/2015 |
| KR | 10-1482110 | 1/2015 |
| KR | 10-2015-0103988 | 9/2015 |
| KR | 10-2015-0125342 | 11/2015 |
| WO | WO 2015/002413 | 1/2015 |
| WO | WO 2015/142058 | 9/2015 |

OTHER PUBLICATIONS

KR20150004741A—machine translation (Year: 2015).*
International Search Report dated Jan. 6, 2017 issued in Application No. PCT/KR2016/012812.
European Search Report dated May 30, 2017 issued in Application No. 16205022.3.
Chinese Office Action dated Sep. 3, 2018 issued in Application No. 201611253806.7 (English translation attached).
United States Office Action dated Jan. 22, 2019 issued in grandparent U.S. Appl. No. 15/392,052.
United States Office Action dated Aug. 25, 2020 issued in co-pending related U.S. Appl. No. 16/252,011.
Indian Office Action dated Sep. 25, 2020 issued in IN Application No. 201817023273.
Japanese Office Action dated Jan. 5, 2021 issued in Application 2018-534926.
United States Office Action dated Sep. 28, 2021 issued in co-pending related U.S. Appl. No. 16/855,431.
United States Office Action dated Jan. 27, 2022 issued in co-pending related U.S. Appl. No. 16/855,431.
United States Office Action dated May 13, 2022 issued in co-pending related U.S. Appl. No. 16/855,431.
KR 10-2013-0022792—Machine translation (Year: 2013).
KR 10-2015-0125342—Machine translation (Year: 2015).
WO 2015/002413—Machine translation (Year: 2015).
Extended European Search Report dated Apr. 18, 2023 issued in Application No. 22212389.5.
U.S. Appl. No. 17/731,837, filed Apr. 28, 2022.
U.S. Appl. No. 17/882,020, filed Aug. 5, 2022.
U.S. Appl. No. 17/882,037, filed Aug. 5, 2022.
U.S. Appl. No. 17/882,058, filed Aug. 5, 2022.
U.S. Appl. No. 17/882,078, filed Aug. 5, 2022.

* cited by examiner

WASHING AGENT PUMP AND LAUNDRY TREATING APPARATUS HAVING THE SAME

CROSS-REFERENCE TO RELATED APPLICATIONS

This application is a Continuation Application of U.S. patent application Ser. No. 16/855,431, filed Apr. 22, 2020, which is a Divisional Application of U.S. patent application Ser. No. 16/252,011 filed Jan. 18, 2019 (now U.S. Pat. No. 11,078,618), which is a Divisional of U.S. patent application Ser. No. 15/392,052 filed Dec. 28, 2016 (now U.S. Pat. No. 10,378,139), which claims priority under 35 U.S.C. § 119 (a), of Korean Application No. 10-2016-0001255, filed on Jan. 5, 2016, the contents of which are incorporated by reference herein in its entirety.

BACKGROUND

1. Field

Provided is a washing agent pump and a laundry treating apparatus having the same.

2. Background

Washing agent pumps and laundry treatment apparatuses having the same are known. However, they suffer from various disadvantages.

BRIEF DESCRIPTION OF THE DRAWINGS

The embodiments will be described in detail with reference to the following drawings in which like reference numerals refer to like elements wherein.

DETAILED DESCRIPTION

Figure 1:
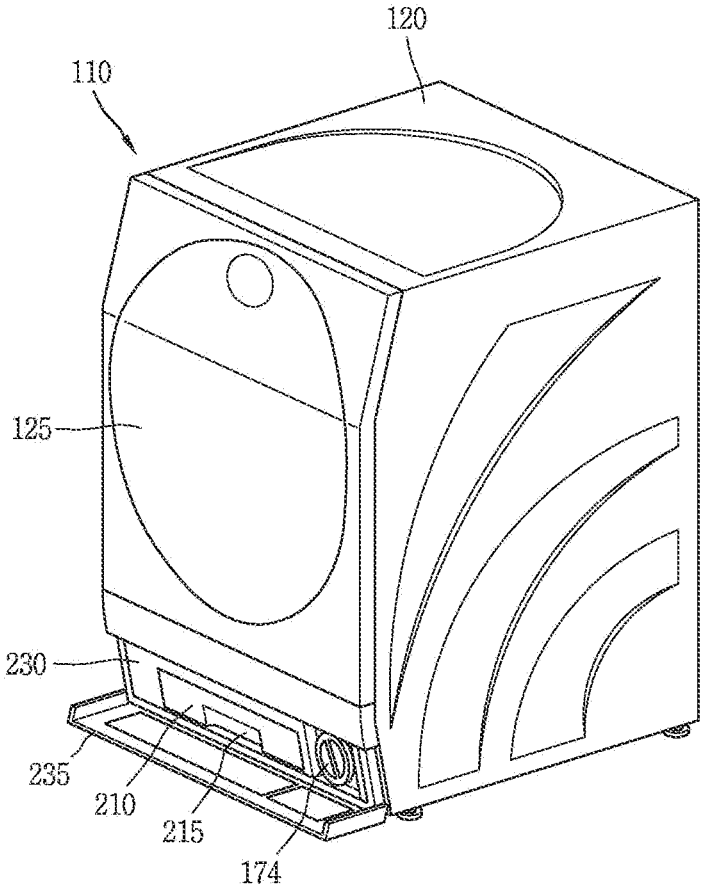
FIG. 1 is a perspective view of a laundry treating apparatus in accordance with one embodiment.

Description will now be given in detail of exemplary embodiments disclosed herein, with reference to the accompanying drawings.

In describing the present invention, moreover, the detailed description will be omitted when a specific description for publicly known technologies to which the invention pertains is judged to obscure the gist of the present invention. Also, it should be noted that the accompanying drawings are merely illustrated to easily explain the spirit of the invention, and therefore, they should not be construed to limit the spirit of the invention by the accompanying drawings.

A laundry treating apparatus is a type of an apparatus for treating (washing) clothes or laundry through a washing process and a rinsing process. The laundry includes not only clothes but also washable articles including bed clothing such as bed clothes, curtains, stuffed dolls, and the like.

The laundry treating apparatus may have a dehydrating function including a spin cycle to spin washed clothes or laundry at a preset speed to remove moisture. Some of such laundry treating apparatuses may have a drying function in which washed clothes or laundry are dried by supplying heated air.

Meanwhile, the laundry treating apparatus may have a washing agent supplying function to supply washing agent to improve a washing effect. Here, the washing agent may include materials, such as laundry detergents, fabric softeners, bleaching agents, and the like, which enhance the washing effect. Hereinafter, all various types of washing agents will be referred to as a washing agent.

As the washing agent, a powder washing agent, a liquid washing agent or a gel-type washing agent may be used. Powder washing agents have the disadvantage in that it may not completely dissolve after washing due to its relatively low dissolution and detergent ingredients may remain in a wash tub or laundry. In consideration of such problems in powder washing agents, liquid washing agents having relatively high dissolution have seen increased use.

Some of these laundry treating apparatuses may include a liquid washing agent supply device for supplying a liquid washing agent to the water. The liquid washing agent supply device may include a storage container in which the liquid washing agent is stored, and a pump provided at a discharge side of the storage container.

However, such laundry treating apparatuses may not accurately detect or fail to detect at all a residual quantity of the liquid washing agent (e.g., a low level of washing agent). This causes the inconvenience in requiring frequent checking of the detergent container. Also, upon performing washing without recognizing a residual quantity shortage of the liquid washing agent in advance, the wash may not be performed properly to clean laundry as desired.

Considering these problems, a sensor may be installed in the detergent container in some laundry treating apparatuses. However, when a sensor is installed in the detergent container, it may interfere with access and make it difficult to draw out the detergent container. It may also cause inconvenience when refilling the liquid washing agent.

With reference to the accompanying drawings, laundry treating apparatuses and a washing agent supply units and a residual quantity detecting unit that address these and other disadvantages is disclosed hereinafter.

Figure 2:
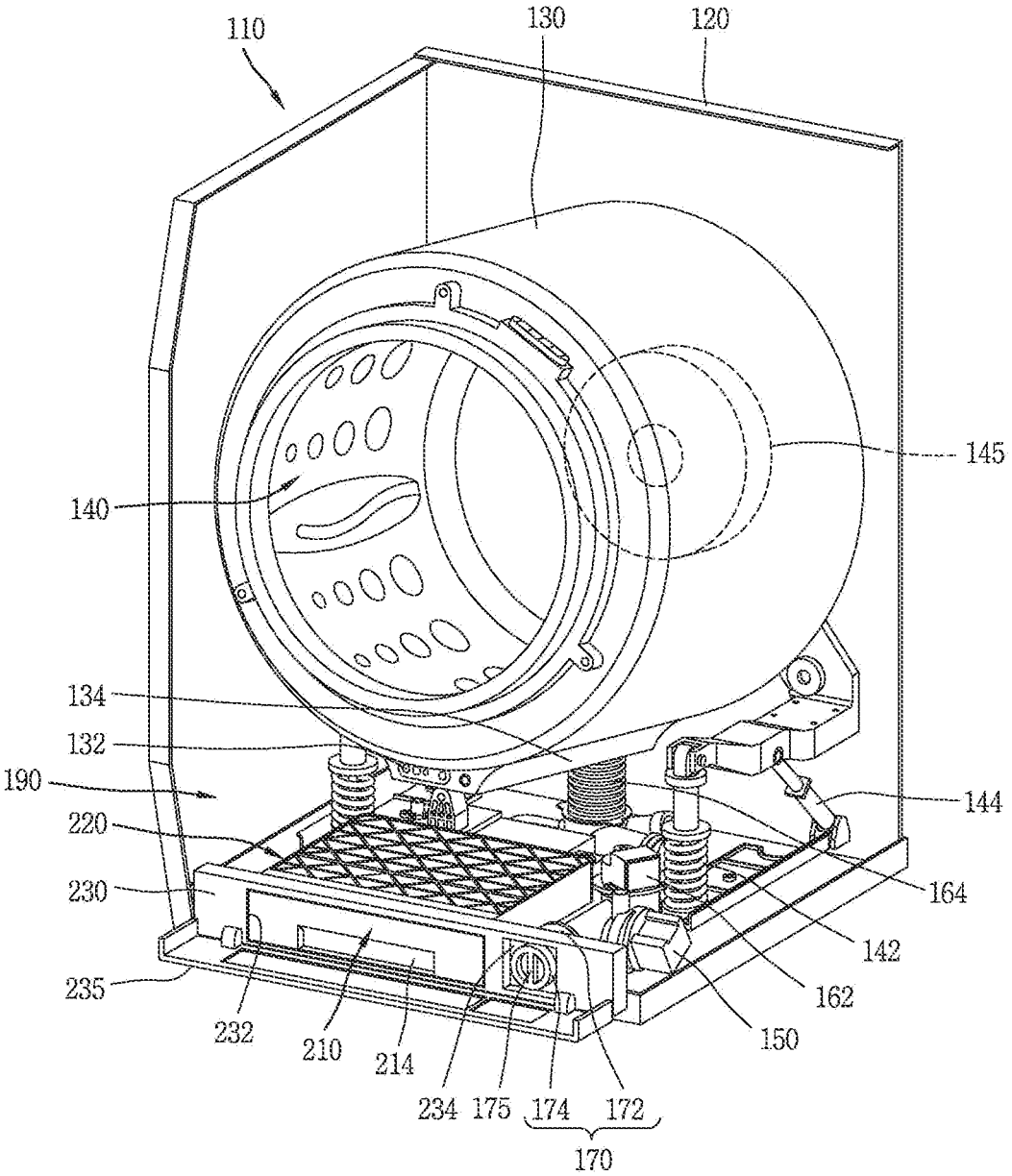
FIG. 2 is a partial perspective view illustrating an inside of a cabinet of FIG. 1.

As illustrated in FIGS. 1 and 2, a laundry treating apparatus in accordance with one embodiment may include a laundry treating apparatus main body 110 and a washing agent supply unit 190 having a storage container 210 for storing a liquid washing agent including liquid detergent or liquid softener that supplies the liquid washing agent of the storage container 210 to the laundry treating apparatus main body 110.

The laundry treating apparatus main body 110 may include a cabinet 120 that defines an outer appearance of the main body 110, a tub 130 provided within the cabinet 120, and a rotary tub (or drum) 140 provided in the tub 130 in a rotatable manner. The cabinet 120, for example, may be implemented in an approximately rectangular parallelepiped shape.

The tub 130, for example, may be implemented in a cylindrical shape with one opening. The tub 130 may be disposed in a manner that the opening faces a front of the cabinet 120. The tub 130 may be supported by a plurality of elastic members 142 and/or dampers 144. Accordingly, vibration of the tub 130 can be prevented.

The rotary tub (or drum) 140 may rotate centering on a rotation shaft provided on one end portion (rear portion) of the tub 130. The rotary tub 140, for example, may be implemented in a cylindrical shape with one opening. The rotary tub 140 may be disposed in a manner in which the opening communicates with the opening of the tub 130.

A driving motor 145 for rotating the rotary tub 140 may be provided in a rear end portion of the tub 130. A door 125 for opening and closing the opening of the tub 130 may be disposed on a front surface of the cabinet 120. The door 125 may be disposed to be relatively rotatable with respect to the cabinet 120. In more detail, for example, the door 125 may be coupled to the cabinet 120 to be rotatable laterally in left and right directions of the cabinet 120, centering on a rotation shaft that is disposed vertically in up and down directions relative to the cabinet 120.

An electric heater 132 for heating water may be provided, for example, in a lower area of the tub 130. A water collecting unit 134 in which water is collected may be provided at the lower area of the tub 130. The water collecting unit 134, for example, may downwardly protrude from a lower portion of the tub 130. The electric heater 132 may be installed to be submerged in water of the water collecting unit 134.

A drain pump 150 for draining out water may be disposed at one area below the tub 130. A circulation passage 160 may be provided along which water is discharged out of the tub 130 and circulates into the tub 130. A circulation pump 162 allowing water to flow upward may be provided in the circulation passage 160. The circulation passage 160 may include a bellows 164 connected to a lower end of the tub 130, and a circulation pipe 166 connected to the bellows 164.

A filter unit 170 that filters off foreign materials from water discharged out of the tub 130 may be provided at one side of the drain pump 150. The filter unit 170, for example, may include a filter casing 172, and a filter 174 detachably accommodated within the filter casing 172.

The filter 174 may be provided with a filter handle 175 provided on a front surface thereof. The filter 174 may be coupled in a manner that the filter handle 175 is externally exposed and a rear area of the filter handle 175 is inserted into the filter casing 172. The filter casing 172, for example, may be connected to one end portion of the circulation pipe 166.

The circulation pump 162, for example, may be connected to an upper side of the circulation pipe 166 in an upwardly protruding manner. A bellows connecting portion 167 connected with the bellows 164 may be formed on another end portion of the circulation pipe 166. The bellows connecting portion 167, for example, may be configured in a hemispherical shape with an upper opening. A water level detecting unit pipe 169 for detecting a water level of the tub 130 may be connected to the bellows connecting portion 167.

A drain pipe 155 through which water is discharged to outside may be connected to a discharge side of the drain pump 150. The circulation passage 160 may be provided with a discharge pipe 168 disposed at a discharge side of the circulation pump 162 and having one end connected to an upper area of the tub 130.

Meanwhile, a washing agent supply unit 190 for supplying a liquid washing agent into the tub 130 may be provided within the cabinet 120. The washing agent supply unit 190, for example, may be provided below the tub 130.

In the present disclosure, liquid washing agent refers to various types of materials, such as liquid fabric detergent, liquid fabric softener (liquid fabric softening agent) or liquid fabric bleaching agent, which improves a washing effect of the laundry.

The washing agent supply unit 190 may include a storage container 210 storing therein a liquid washing agent including liquid detergent or liquid softener and drawn out of the cabinet 120, a washing agent supply passage 260 formed between the storage container 180 and the tub 130 and allowing a supply of the liquid washing agent therethrough, and a washing agent delivery member provided in the washing agent supply passage 260.

The washing agent delivery member may be referred to herein as a washing agent delivery unit or a washing agent delivery device. The washing agent delivery member, for example, may be implemented as a washing agent pump 280 provided in the washing agent supply passage 260. A storage container accommodating portion 220 may be provided in which the storage container 210 is accommodated to be drawn out thereof.

A frame 230 having a draw-out opening 232 formed therethrough for drawing out the storage container 210 may be disposed at the front of the storage container accommodating portion 220. A filter opening 234 through which the filter 174 is detached may be formed through the frame 230.

A cover 235 for opening and closing the draw-out opening 232 and the filter opening 234 may be provided on the front of the frame 230. The cover 235 may be rotatable vertically with respect to the frame 230. The cover 235 may rotate centering on a rotation shaft provided on a lower end of the frame 230.

The storage container 210, for example, may be provided with a detergent storing portion **212*a* that stores the liquid detergent therein, and a softener storing portion 212*b* that stores the liquid softener therein. A storage container handle 215 may be provided on a front surface of the storage container 210. This may facilitate the storage container 210 to be drawn out, accessed and replaced. The storage container 210 may be configured to be slidably coupled to the cabinet 120**.

The detergent storing portion **212*a* and the softener storing portion 212*b* may store the detergent and the softener, respectively, by being divided by a partition wall 213 provided within a uni-body. The detergent storing portion 212*a* and the softener storing portion 212*b* may be provided with injection opening covers 216*a* and 216*b***, respectively, for opening and closing injection openings thereof.

An installation space 225 in which the washing agent pump 280 is accommodated may be provided in the rear side of the storage container accommodating portion 220. The installation space 225, for example, may be open toward the rear of the cabinet 120. A washing agent supply passage 260 through which the washing agent is supplied may be formed at one side, for example, at the rear side of the installation space 225.

Figure 3:
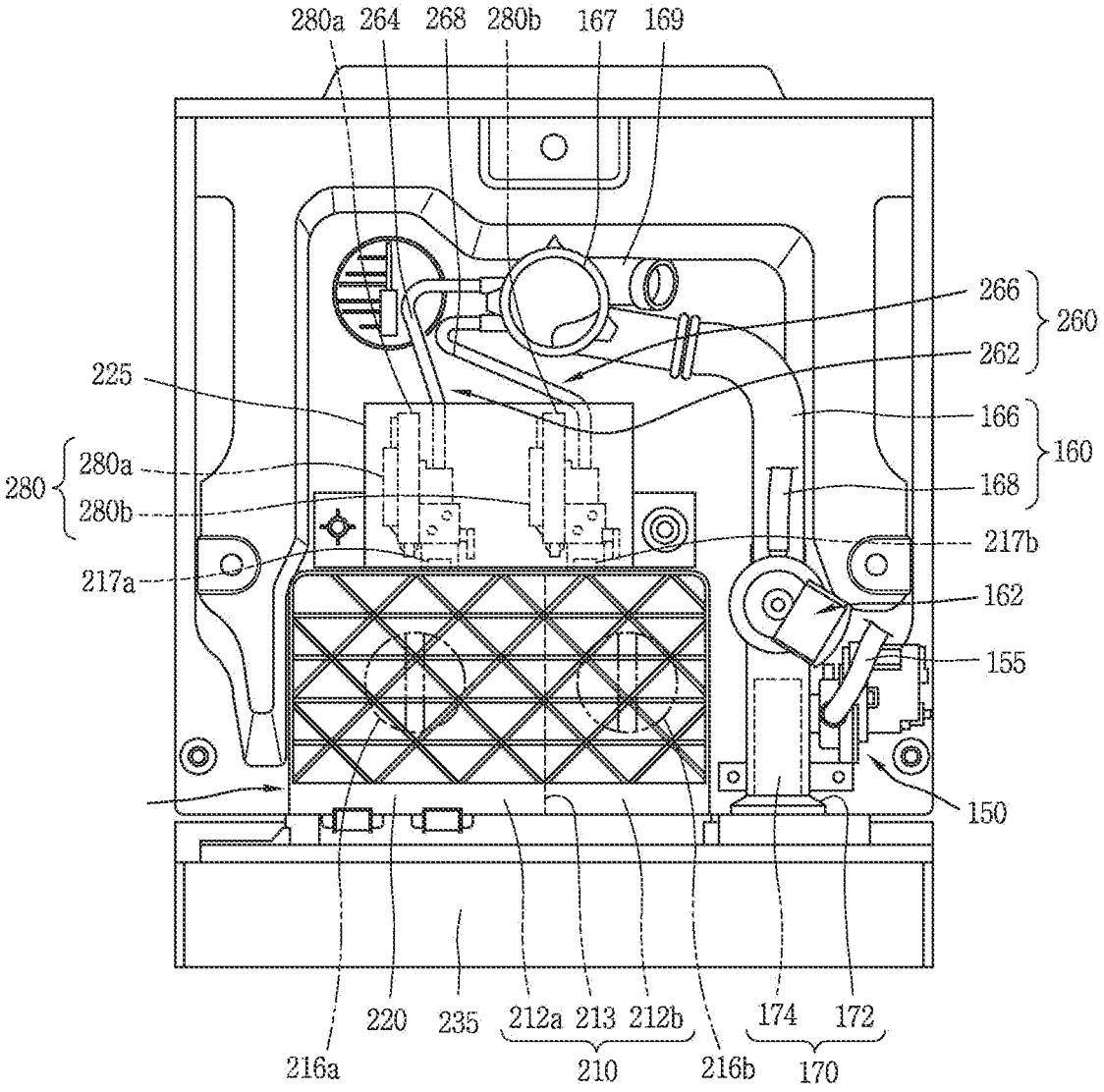
FIG. 3 is a planar view of a washing agent supply unit area of FIG. 2.

The washing agent pump 280, for example, may include a detergent pump 280*a* connected to the detergent storing portion 212*a*, and a softener pump 280*b* connected to the softener storing portion 212*b*. The washing agent supply passage 260, for example, as illustrated in FIG. 3, may include a detergent supply passage 262 supplying the detergent therethrough, and a softener supply passage 266 supplying the softener therethrough.

The detergent supply passage 262, for example, may be provided with a detergent discharge pipe 264 having one end connected to a discharge side of the detergent pump 280*a*, which is connected to the storage container accommodating portion 220, and another end connected to the bellows connecting portion 167. The softener supply passage 266, for example, may be provided with a softener discharge pipe 268 having one end connected to a discharge side of the softener pump 280*b*, and another end connected to the bellows connecting portion 167, Here, the detergent discharge pipe 264 and the softener discharge pipe 268 may all be connected to the bellows connecting portion 167, such that the washing agent can be supplied into the tub 130 after being diluted by being mixed with water of the bellows connecting portion 167 before flowing into the tub 130. With this configuration, the washing agent can be brought into contact with the laundry after being diluted by water, which may result in preventing damage on the laundry caused due to a direct contact between a high concentration washing agent and the laundry.

The detergent pump 280*a* and the softener pump 280*b* may be connected to the storage container accommodating portion 220 in communication with the detergent storing portion 212*a* and the softener storing portion 212*b*, respectively. The detergent storing portion 212*a* of the storage container 210 may be provided with a detergent pump connecting portion 217*a* that communicates with the detergent pump 280*a* when the storage container 210 is accommodated, and configured to block leakage of liquid detergent from the detergent storing portion 212*a* when the storage container 210 is drawn out. The softener storing portion 212*b* of the storage container 210 may be provided with a softener pump connecting portion 217*b* that communicates with the softener pump 280*b* when the storage container 210 is accommodated, and configured to block leakage of liquid softener from the softener storing portion 212*b* when the storage container 210 is drawn out.

Hereinafter, a washing agent pump in accordance with one embodiment of the present disclosure will be described with reference to FIGS. 4 to 9.

Figure 4:
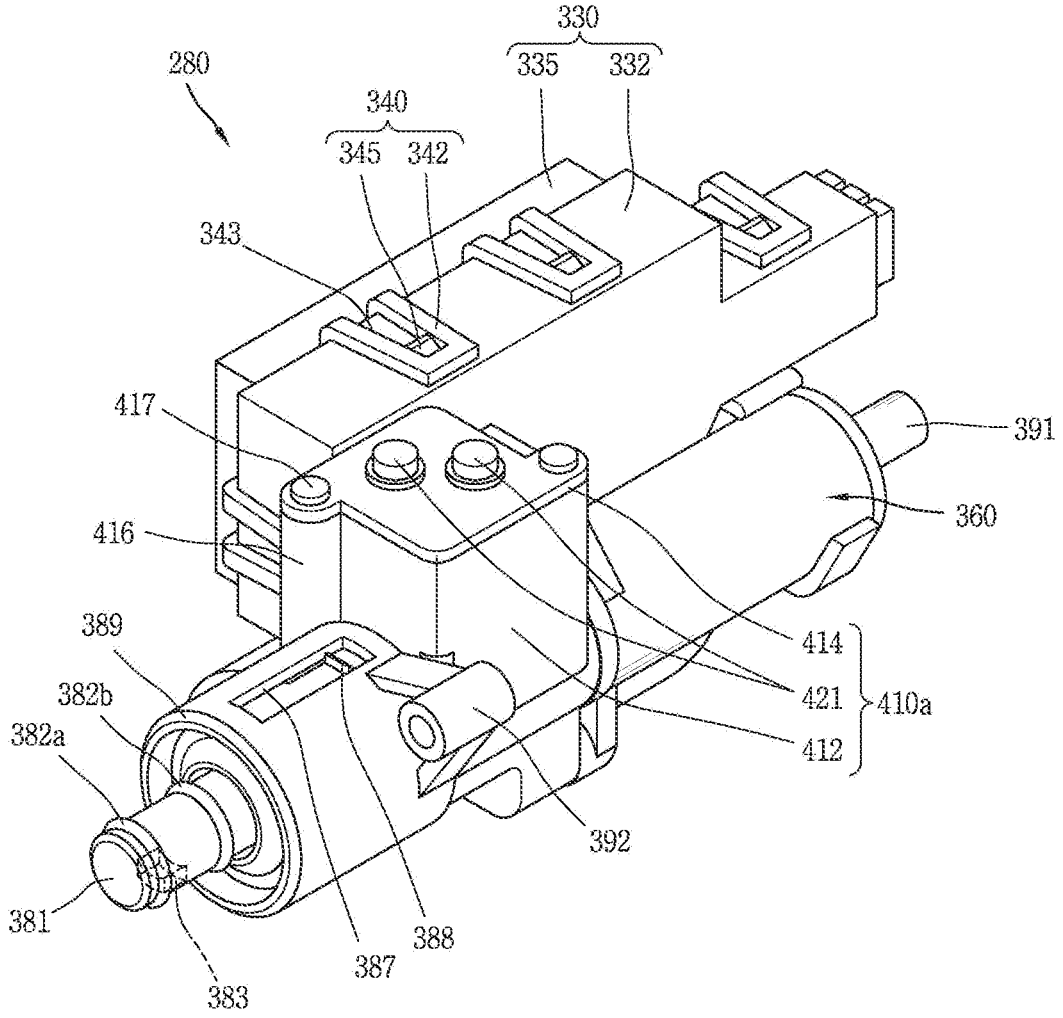
FIG. 4 is a perspective view of a washing agent pump of FIG. 3.
Figure 5:
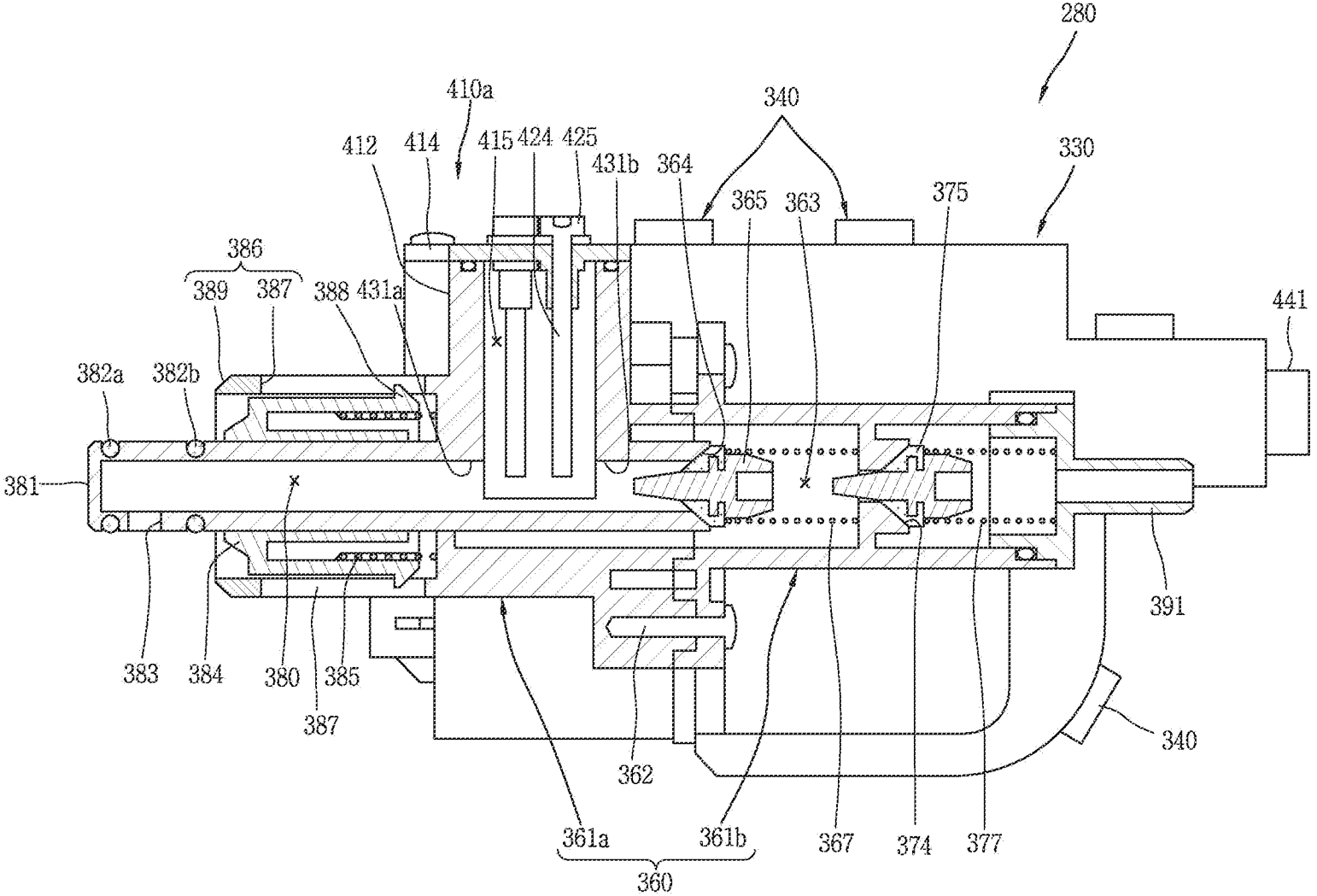
FIG. 5 is a sectional view illustrating a passage forming member area of the washing agent pump of FIG. 4.
Figure 6:
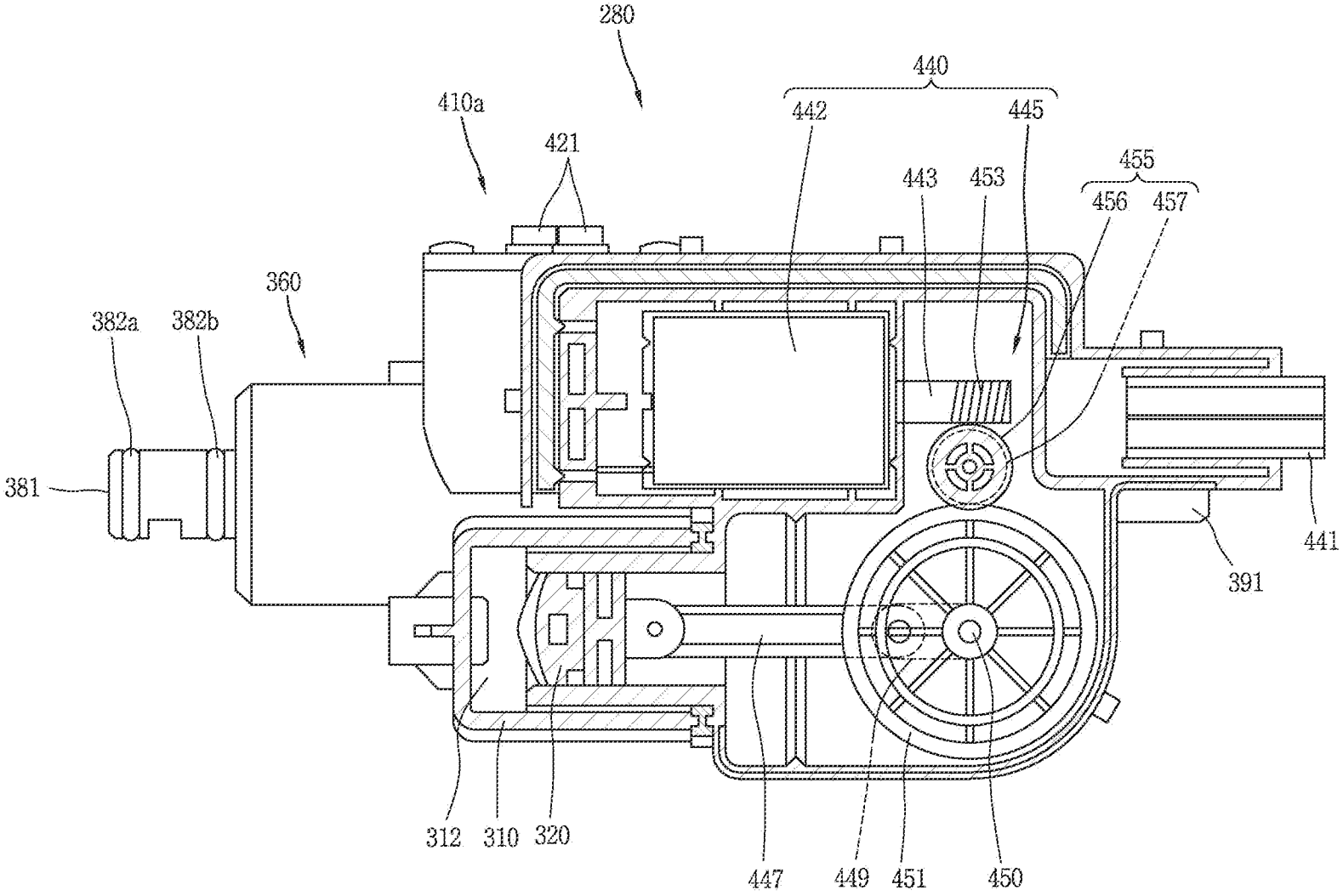
FIG. 6 is a sectional view illustrating a piston operating unit area of the washing agent pump of FIG. 4.
Figure 7:
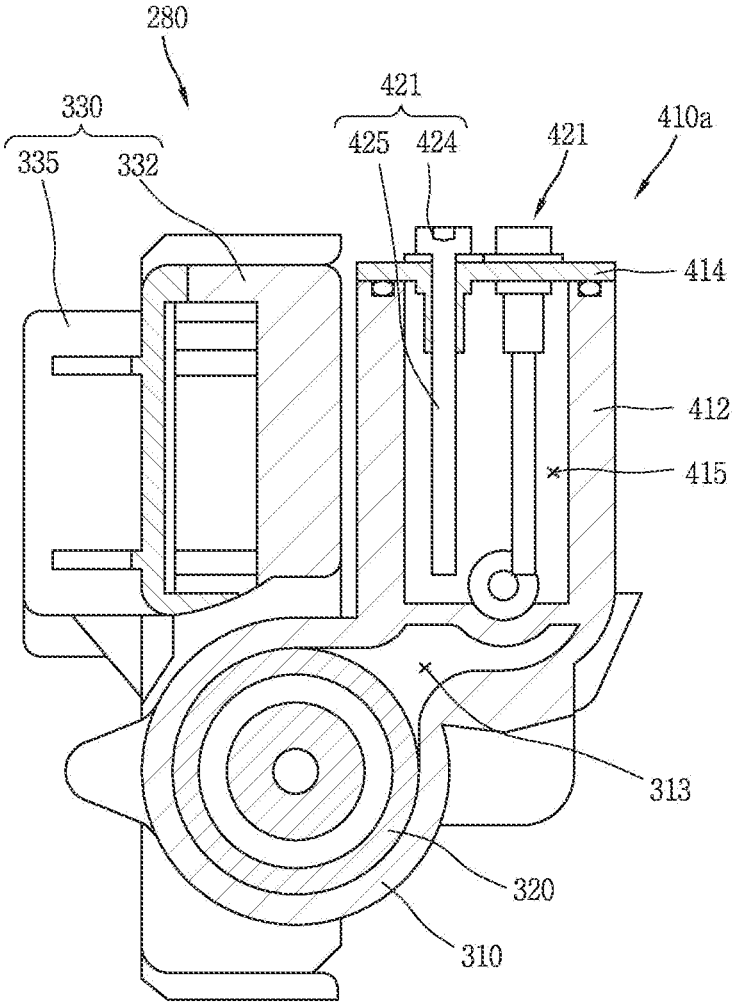
FIG. 7 is a sectional view illustrating a residual quantity detecting unit of the washing agent pump of FIG. 4.

As illustrated in FIGS. 4 to 6, a washing agent pump 280 in accordance with one embodiment may include a cylinder 310 that draws in and discharges a liquid washing agent including liquid detergent or liquid softener, a piston 320 reciprocating within the cylinder 310, and a residual quantity detecting unit 410*a* to detect residual quantity or low levels of washing agent. The residual quantity detecting unit 410*a* may have an air pocket 415 in communication with an intake-side passage or a discharge-side passage for the liquid washing agent of the cylinder 310 and may temporarily store therein air and the liquid washing agent. The residual quantity detecting unit 410*a* may also include an electrode 421 disposed within the air pocket 415 to come into contact with the liquid washing agent, and configured to detect a residual quantity of the liquid washing agent. The air pocket 415 may be a cavity or space formed in the body of the residual quantity detecting unit 410*a*, and may also be referred to herein as an air pocket cavity or space.

The washing agent pump 280 may further include a passage forming member 360 that forms a passage for the liquid washing agent and a pressing space 363. The passage forming member 360 may also be referred to as a passage body in which the flow passage is formed. The pressing space 363 may also be referred to as a pressure/pressurized space or cavity.

The passage forming member 360 may be provided with an intake valve 365 that opens and closes an inlet port 364 of the pressing space 363, and a discharge valve 375 that opens and closes an outlet port 374 of the pressing space 363, such that the pressing space 363 communicates with the inside of the cylinder 310.

The washing agent pump 280, for example, may be provided with a piston operating unit 440 by which the piston 320 operates in a reciprocating manner. The washing agent pump 280 may further include a case 330 that supports the cylinder 310, the piston 320 and the piston operating unit 440 in an accommodating manner. The case 330, for example, may include a case body 332 that forms an internal accommodation space, and a case cover 335 that opens and closes the case body 332.

The cylinder 310, for example, as illustrated in FIG. 6, may be coupled into the case body 332. The piston 320 may be inserted into the cylinder 310 to reciprocate therein. The piston operating unit 440 may be provided at another side within the case body 332. The piston operating unit 440, for example, may include an electric motor 442 that generates driving force upon applying power, and a driving force transfer portion 445 that transfers the driving force of the electric motor 442 to the piston 320.

The driving force transferring portion 445, for example, may include a piston rod 447 having one end portion connected to the piston 320, a crankshaft 449 connected to another end portion of the piston rod 447, a driven gear 451 provided on a rotation shaft 450 of the crankshaft 449 and rotating integrally with the rotation shaft 450, a driving gear 453 disposed on a rotation shaft 443 of the electric motor 442, and a driving force transfer gear engaged with the driving gear 453 and the driven gear 451, respectively, to transfer rotational force of the driving gear 453 to the driven gear 451.

The driving gear 453, for example, may be a worm gear provided on the rotation shaft 443 of the electric motor 442. The driving force transfer gear 455, for example, may include a first gear 456 configured as a worm wheel rotating with being engaged with the worm gear, and a second gear 457 rotated by being integrally coupled to a rotation shaft of the worm wheel and rotated by being engaged with the driven gear 451.

The case body 332 and the case cover 335 may be engaged with each other by engagement portions 340. Each of the engagement portions 340 may include a coupling rib 342 that extends from one of the case body 332 and the case cover 335 to the another, and an engagement protrusion 345 that protrudes from the another to be engaged with the coupling rib 342. A protrusion insertion hole 343 may be formed through the coupling rib 342 such that the engagement protrusion 345 may be inserted therethrough.

This embodiment exemplarily illustrates that the coupling rib 342 is provided on the case cover 335 and the engagement protrusion 345 is provided on the case body 332, but this is merely illustrative. Alternatively, the coupling rib may be provided on the case body 332 and the engagement protrusion may be provided on the case cover 335.

The passage forming member 360 may be integrally coupled to one side of the case body 332. The passage forming member 360, for example, as illustrated in FIG. 5, may be provided with a first body 361*a* and a second body 361*b* that are coupled to each other in a lengthwise direction. The first body 361*a* and the second body 361*b* may be coupled integrally to each other by coupling members 362.

The passage forming member 360 may form a passage of the liquid washing agent and the pressing space 363, and include the intake valve 365 for opening and closing the inlet port 364 of the pressing space 363, and the discharge valve 375 for opening and closing the outlet port 374 of the pressing space 363.

The passage forming member 360 may be configured in an approximately cylindrical shape. The first body 361*a* and the second body 361*b*, for example, may all be formed in a cylindrical shape. A coupling portion 392 to be coupled to the installation space 225 may be provided on one side of the passage forming member 360.

The pressing space 363 that communicates with the cylinder 310, for example, may be formed within the passage forming member 360, as illustrated in FIG. 5. The pressing space 363 may be formed within the second body 361*b*.

A communication passage 313 (see FIG. 7) may be formed between the passage forming member 360 and the case 330 to communicate an inner space 312 of the cylinder 310 and the pressing space 363 with each other. Accordingly, during a reciprocating motion of the piston 320, each of suction force and compression force may be applied into the pressing space 363. The communication passage 313, for example, may be formed via the case 330 and a lower area of the passage forming member 360.

The inlet port 364 and the outlet port 374 may be formed at an upstream side and a downstream side of the pressing space 363, respectively, along a flowing direction of the liquid washing agent (detergent). The intake valve 365 may be provided in the inlet port 364 to open and close the inlet port 364. The intake valve 365 may be provided within the pressing space 363.

An intake valve spring 367 that applies elastic force in a direction that the intake valve 365 blocks the inlet port 364 may be provided at one side of the intake valve 365. The intake valve 365 may be restored to its initial position of blocking the inlet port 364 by the intake valve spring 367.

The discharge valve 375 may be provided in the outlet port 374 to open and close the outlet port 374. The discharge valve 375 may be provided outside of the pressing space 363 (at a downstream side of the outlet port 374).

A discharge valve spring 377 that applies elastic force in a direction that the discharge valve 375 blocks the outlet port 374 may be provided at one side of the discharge valve 375. The discharge valve 375 may be restored to its initial position of blocking the outlet port 374 by the discharge valve spring 377.

Meanwhile, the passage forming member 360 may be provided therein with a residual quantity detecting unit 410*a* that detects a residual quantity of the washing agent. The residual quantity detecting unit 410*a* (see FIG. 5), for example, may be disposed at an upstream side of the pressing space 363 in the flowing direction of the liquid washing agent.

The residual quantity detecting unit 410*a*, for example, may include an air pocket 415 in the communication with the passage of the passage forming member 360 and temporarily storing therein air and the liquid washing agent, and an electrode 421 disposed within the air pocket 415 to be contactable with the liquid washing agent.

The passage forming member 360 may be provided with an introduction end portion 381 through which the liquid washing agent is introduced and an discharge end portion 391 through which the liquid washing agent is discharged. The discharge end portion 391 may be formed at the downstream side of the pressing space 363 in a manner of extending from the outlet port 374 of the pressing space 363. The introduction end portion 381 may be formed at the upstream side of the pressing space 363 in a manner of extending from the inlet port 364 of the pressing space 363.

An introduction space 380 in which the liquid washing agent is introduced may be disposed at the upstream side of the pressing space 363. An introduction hole 383 through which the liquid washing agent is introduced into the introduction space 380 may be formed through one side of the introduction end portion 381. The introduction hole 383, for example, may be formed through a bottom surface of the introduction end portion 381 in a circumferential direction of the introduction space 380.

This embodiment exemplarily illustrates that the introduction hole is formed through the lower side in the drawing, but the introduction hole may alternatively be formed through a side surface or an upper surface in the circumferential direction.

Here, the introduction space 380, for example, may refer to a volume or cavity of a passage for the liquid washing agent from a left end portion of the first body 361*a* of the passage forming member 360 to the inlet port 364 of the pressing space 363.

The introduction end portion 381 may be inserted into the detergent pump connecting portion 217*a* or the softener pump connecting portion 217*b*. An introduction hole opening/closing member 384 that opens and closes the introduction hole 383 may be provided on the introduction end portion 381. The introduction hole opening/closing member 384 may be coupled to a circumference of the introduction end portion 381 to be slidable along a lengthwise direction of the passage forming member 360.

When the introduction end portion 381 is inserted into the detergent pump connecting portion 217*a* or the softener pump connecting portion 217*b*, the introduction hole opening/closing member 384 may be relatively slid as an end portion of the introduction hole opening/closing member 384 is brought into contact with an end portion of the detergent pump connecting portion 217*a* or the softener pump connecting portion 217*b*. Accordingly, the introduction hole opening/closing member 384 can open the introduction hole 383.

The introduction hole opening/closing member 384, for example, may be formed in a cylindrical shape. An introduction hole opening/closing member accommodating portion 386 may be provided at outside of a periphery of the introduction hole opening/closing member 384 to accommodate the introduction hole opening/closing member 384 when opening the introduction hole 383.

A coupling protrusion 388 may outwardly protrude from the introduction hole opening/closing member 384 in a radial direction. The coupling protrusion 388 may be provided in plurality. Each of the coupling protrusions 388 may be spaced apart from an outer surface of the introduction hole opening/closing member 384 in the radial direction. Each coupling protrusion 388 may be moved close to or away from (elastically transformed with respect to) the introduction hole opening/closing member 384.

Coupling protrusion accommodating portions 387 for accommodating the coupling protrusions 388 may be provided in the introduction hole opening/closing member accommodating portion 386. Each of the coupling protrusion accommodating portions 387 may be brought into contact with the coupling protrusion 388 so as to restrict the movement of the coupling protrusion 388, thereby preventing the introduction hole opening/closing member 384 from suddenly being separated from the introduction hole opening/closing member accommodating portion 386.

An introduction hole opening/closing member spring 385 may be provided within the introduction hole opening/closing member accommodating portion 386. The introduction hole opening/closing member spring 385 may apply elastic force to the introduction hole opening/closing member 384 such that the introduction hole opening/closing member 384 can move to a closing position of closing the introduction hole 383.

A coupling portion 389 coupled to the storage container accommodating portion 220 may be provided on an end portion of the introduction hole opening/closing member accommodating portion 386. Sealing members 382*a* and 382*b* may be provided on both sides of the introduction hole 383 at the introduction end portion 381. The sealing members 382*a* and 382*b* may be brought into contact with an inner surface of the introduction hole opening/closing member 384, which has been moved to the closing position by the elastic force of the introduction hole opening/closing member spring 385 upon drawing out the storage container 210, thereby preventing a leakage of the liquid washing agent through the introduction hole 383.

Meanwhile, the air pocket 415, for example, may be configured such that a lower portion thereof communicates with the passage of the liquid washing agent to temporarily accommodate the liquid washing agent. Also, the air pocket 415 may upwardly protrude above the passage so as to accommodate air above the liquid washing agent.

In more detail, the air pocket 415 may be formed by an air pocket forming portion 412 having a lower end communicating with the passage of the passage forming member 360 and an upper end protruding in an open state, and an air pocket cover 414 coupled to the upper end of the air pocket forming portion 412. The air pocket forming portion 412, for example, may be formed in a rectangular parallelepiped shape.

The air pocket forming portion 412 may be provided with coupling member coupling portions 416 to which coupling members 417 inserted through the air pocket cover 414 are coupled (see FIG. 4). The coupling member coupling portions 416, for example, may be formed on edges in a diagonal direction of the air pocket forming portion 412 and the air pocket cover 414, respectively.

The air pocket cover 414 may be provided with an electrode 421 that downwardly extends into the pair pocket forming portion 412 to contact the washing agent flowing along the passage of the passage forming member 360. The electrode 421, for example, may be provided as a pair.

Each of the electrodes 421 may have a length such that a lower end thereof is disposed lower then an upper end of a cross-section of the passage. In more detail, for example, each electrode 421 may be disposed in a range that the lower end thereof is lower than the upper end of the cross-section of the passage and higher than a center of the cross-section of the passage. This may result in correctly detecting the residual quantity of the liquid washing agent.

Meanwhile, a volume of the air pocket 415 may be greater than that of the introduction space 380. In more detail, the volume of the air pocket 415 may be greater by more than 2 times the volume of the introduction space 380. This may result in effectively preventing incorrect detection of the residual quantity of the liquid washing agent, caused due to bubbles generated during the flow of the liquid washing agent (detergent).

More concretely, during the flow of the liquid washing agent, air may be stored in the air pocket 415 in a compressed state so as to prevent the bubble generated due to the flow of the washing agent from upwardly moving along the electrodes 421. This may result in preventing the incorrect detection of the residual quantity caused due to the upward movement of the bubbles.

With the configuration, when the electric motor 442 rotates in response to power applied thereto, the driving gear 453, the driving force transfer gear 455 and the driven gear 451 may rotate, and accordingly the crankshaft 449 may rotate. In response to the rotation of the crankshaft 449, the piston rod 447 may perform a reciprocating motion and the piston 320 may perform the reciprocating motion within the cylinder 310 accordingly.

Figure 8:
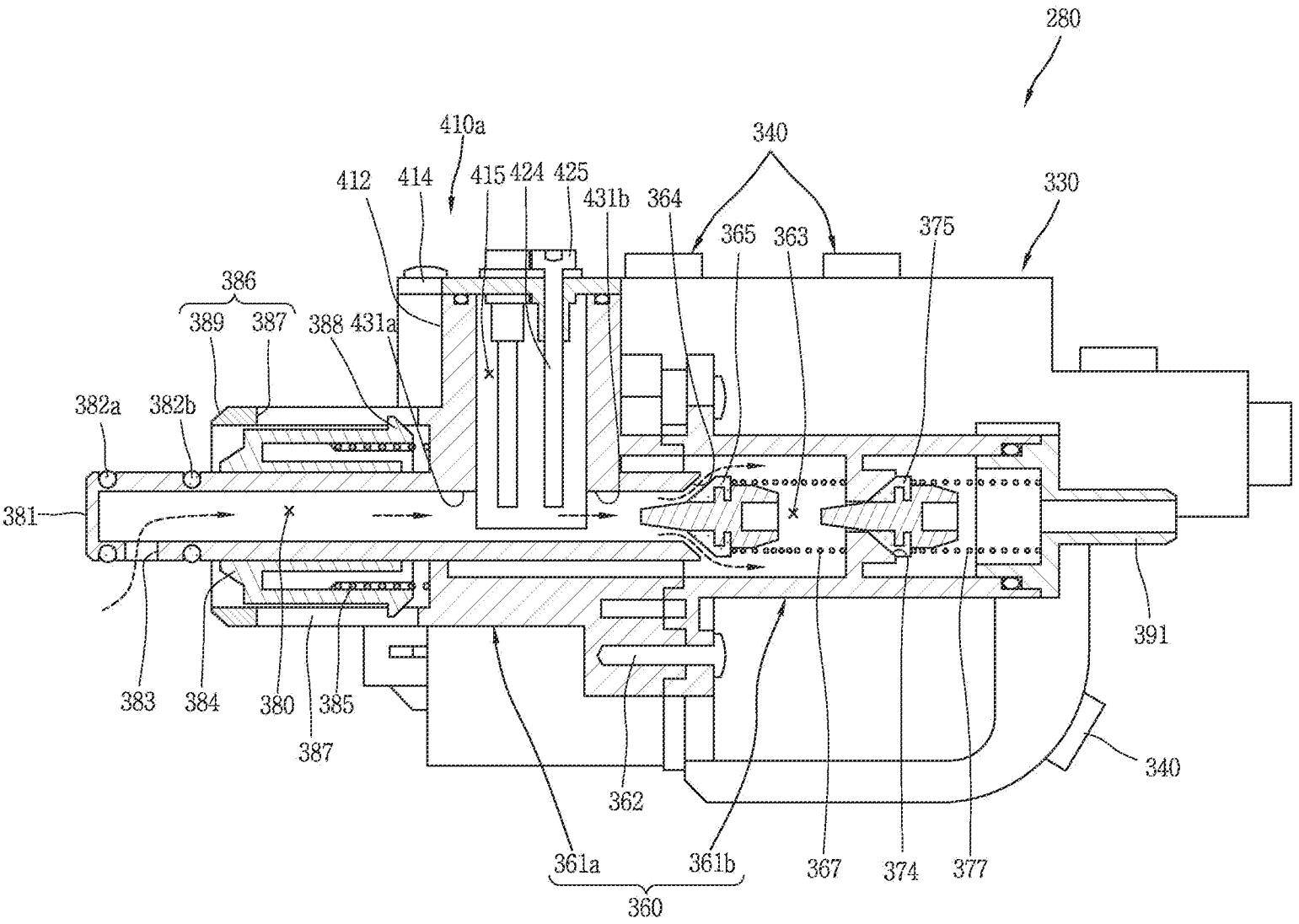
FIG. 8 is a view illustrating a detergent introduction process of FIG. 5.

When the piston 320 is moved in a direction that an inner volume of the cylinder 310 extends, as illustrated in FIG. 8, suction force is generated in the pressing space 363 that communicates with the inside of the cylinder 310 via the communication passage 313, and accordingly the intake valve 365 opens the inlet port 364 by the suction force.

When the inlet port 364 is open, the liquid washing agent within the storage container 210 may be introduced into the introduction space 380 through the introduction hole 383, and then flow into the pressing space 363 through the inlet port 364.

Figure 9:
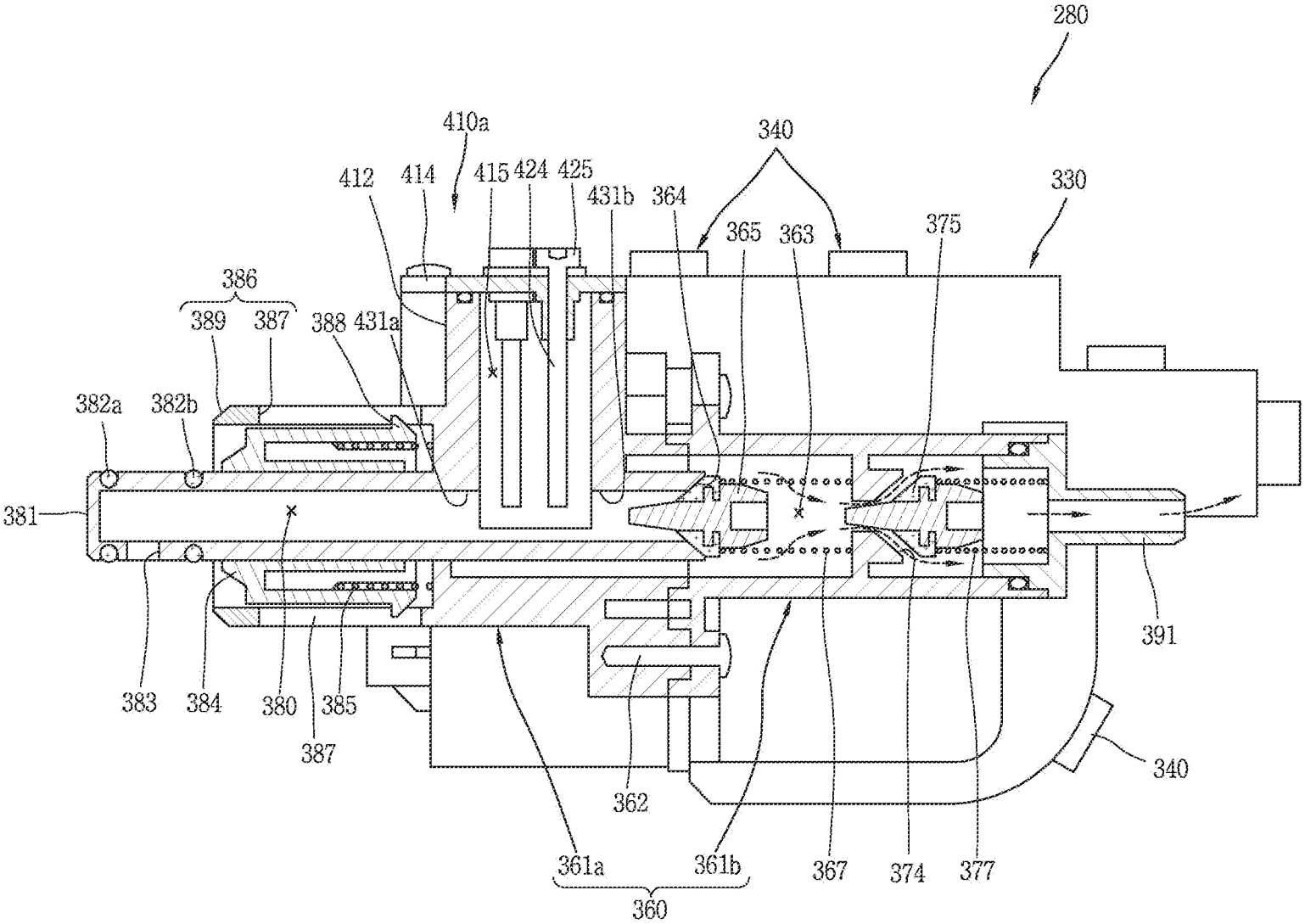
FIG. 9 is a view illustrating a detergent discharge process of FIG. 5.

When the piston 320 is moved in a direction that the inner volume of the cylinder 310 is reduced, as illustrated in FIG. 9, an inside of the pressing space 363 is compressed, and thus, the discharge valve 375 opens the outlet port 374 by the compression force of the piston 320.

When the outlet port 374 is open, the compression force of the piston 320 is applied to the liquid washing agent (detergent, softener). Accordingly, the liquid washing agent may flow along the washing agent supply passage 260 (detergent supply passage 262 or softener supply passage 266) to be introduced into the bellows connecting portion 167. The liquid washing agent (detergent) introduced into the bellows connecting portion 167 may then be mixed with water and then introduced into the tub 130 along the circulation passage 160.

When the electric motor 442 is stopped, the intake valve 365 and the discharge valve 375 may be restored to initial positions thereof, respectively, by the elastic force of the intake valve spring 367 and the elastic force of the discharge valve spring 377, thereby closing the inlet port 364 and the outlet port 374, respectively.

Meanwhile, when the supply of the liquid washing agent is completed, the residual quantity detecting unit 410*a* may detect the residual quantity of the liquid washing agent remaining in the portion of the air pocket 415. Here, air is collected within the air pocket 415 during the flow of the liquid washing agent and a relatively a large amount of air is collected and compressed with lapse of time. Accordingly, the bubbles generated during the low of the liquid washing agent can be prevented from flowing up along the electrodes 421.

Consequently, when a shortage of the residual quantity of the liquid washing agent within the lower portion of the air pocket 415 is actually caused, the bubbles other than the liquid washing agent may flow up and simultaneously be brought into contact with the pair of electrodes 421, thereby preventing the incorrect detection of the residual quantity of the liquid washing agent.

Hereinafter, a washing agent pump according to another embodiment will be described with reference to FIGS. 10 to 12.

Figure 10:
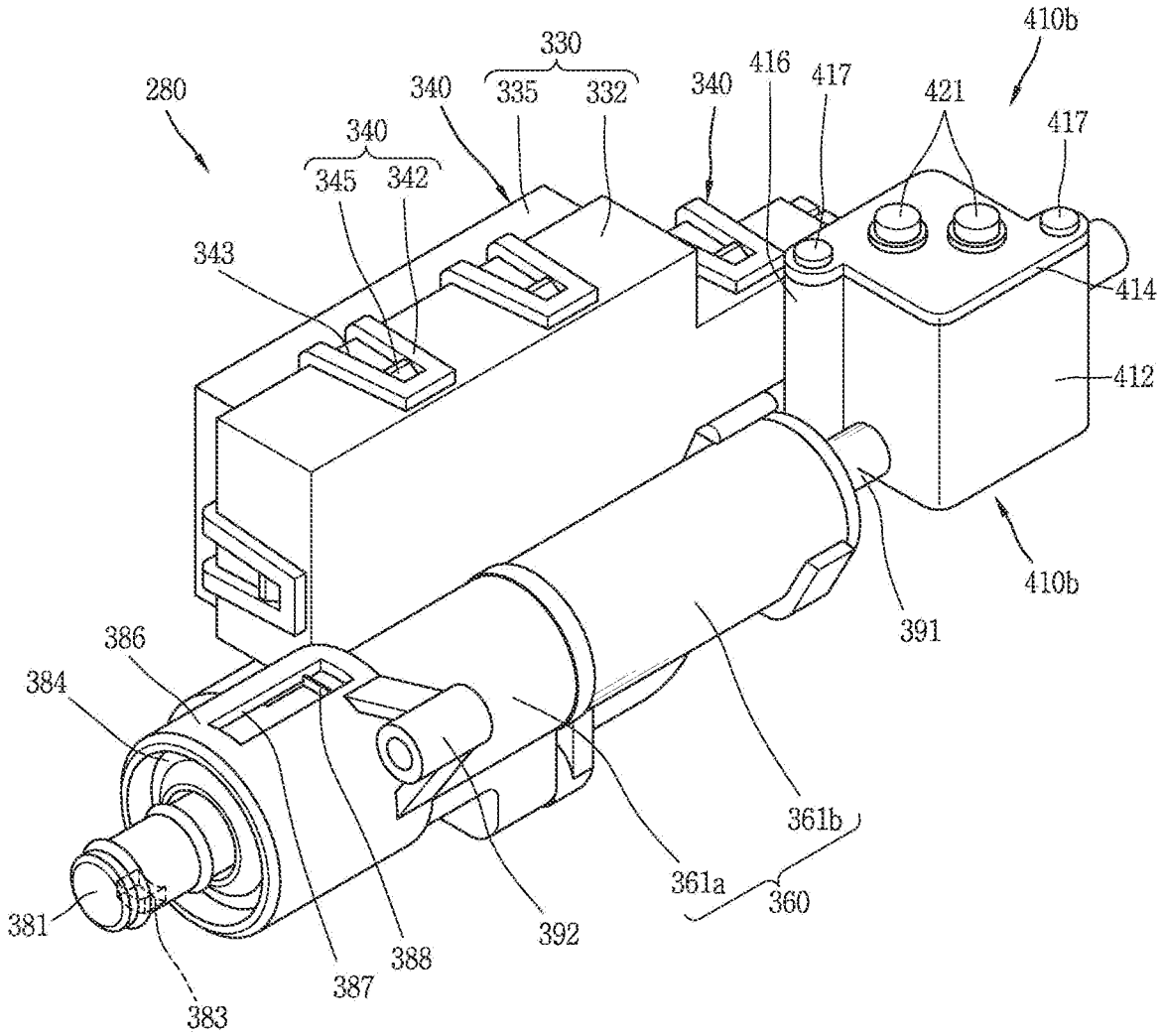
FIG. 10 is a perspective view of a washing agent pump in accordance with another embodiment.
Figure 11:
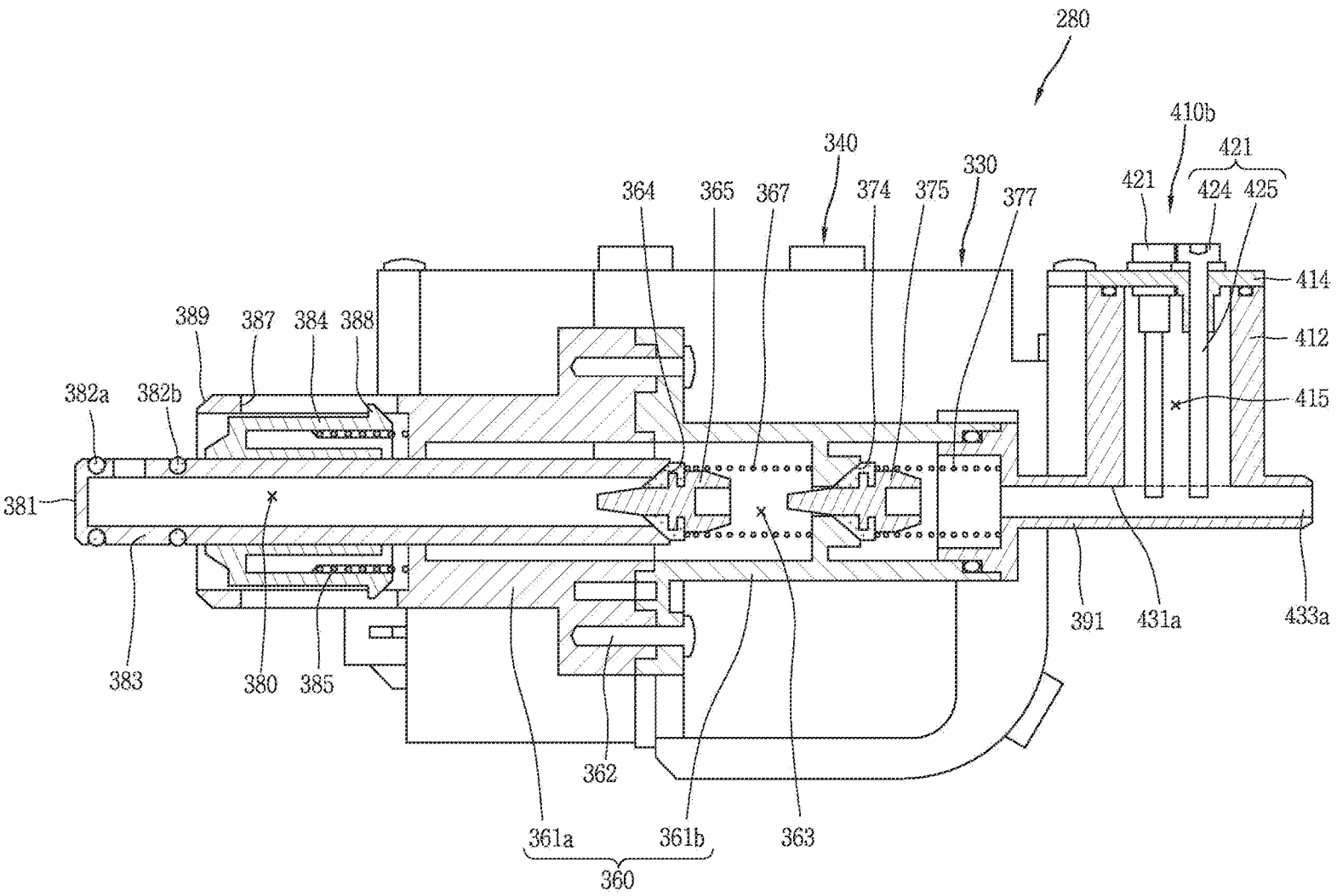
FIG. 11 is a sectional view of the washing agent pump of FIG. 10.

As illustrated in FIGS. 10 and 11, a washing agent pump 280 according to this embodiment, for example, may include a cylinder 310 that pulls in and discharges a liquid washing agent including liquid detergent or liquid softener, and a piston 320 reciprocating within the cylinder 310. A residual quantity detecting unit 410*b* may be provided that detects a residual quantity of the liquid washing agent. An air pocket 415 may be formed to communicate with an intake-side passage or a discharge-side passage of the liquid washing agent of the cylinder 310 and may temporarily store therein air and the liquid washing agent. An electrode 421 may be disposed within the air pocket 415 to come into contact with the liquid washing agent.

The washing agent pump 280 may further include a passage forming member 360 that forms a passage for the liquid washing agent and a pressing space 363. An intake valve 365 for opening and closing an inlet port 364 of the pressing space 363 and a discharge valve 375 for opening and closing an outlet port 374 of the pressing space 363 may be provided such that the pressing space 363 communicates with an inside of the cylinder 310.

The passage forming member 360, for example, may be formed in an approximately cylindrical shape. Moreover, the passage forming member 360 may be provided with an introduction end portion 381 through which the liquid washing agent is introduced along a flowing direction of the liquid washing agent, and an discharge end portion 391 through which the liquid washing agent is discharged.

The washing agent pump 280 may further include a case 330 accommodating therein the cylinder 310, the piston 320 and the piston operating unit 440 in a supporting member. The case 330, for example, may be provided with a case body 332 forming an internal accommodation space, and a case cover 335 opening and closing the case body 332.

Meanwhile, the residual quantity detecting unit 410*b* may be disposed at a downstream side of the pressing space 363 in the flowing direction of the liquid washing agent. In more detail, the residual quantity detecting unit 410*b* may be provided at the discharge end portion 391 of the passage forming member 360.

The introduction portion 391 may be provided therein with an air pocket forming portion 412 that protrudes upward to form the air pocket 415, and an air pocket cover 414 closing an upper end of the air pocket forming portion 412. The air pocket forming portion 412, for example, may be formed in a rectangular parallelepiped shape.

The air pocket cover 414 may be provided therein with the electrode 421 that is disposed within the air pocket forming portion 412 in a manner of extending downward in a vertical or in up and down directions. The electrode 421 may be provided as a pair.

The air pocket 415 may be provided with an introduction portion 431*a* through which the liquid washing agent is introduced, and a discharge portion 433*a* through which the liquid washing agent is discharged. The introduction portion 431*a* and the discharge portion 433*a* may be spaced apart from each other in the flowing direction of the liquid washing agent. The discharge portion 433*a* may be located at a downstream side of the introduction portion 431*a*. The introduction portion 431*a* and the discharge portion 433*a* may have the same height.

Figure 12:
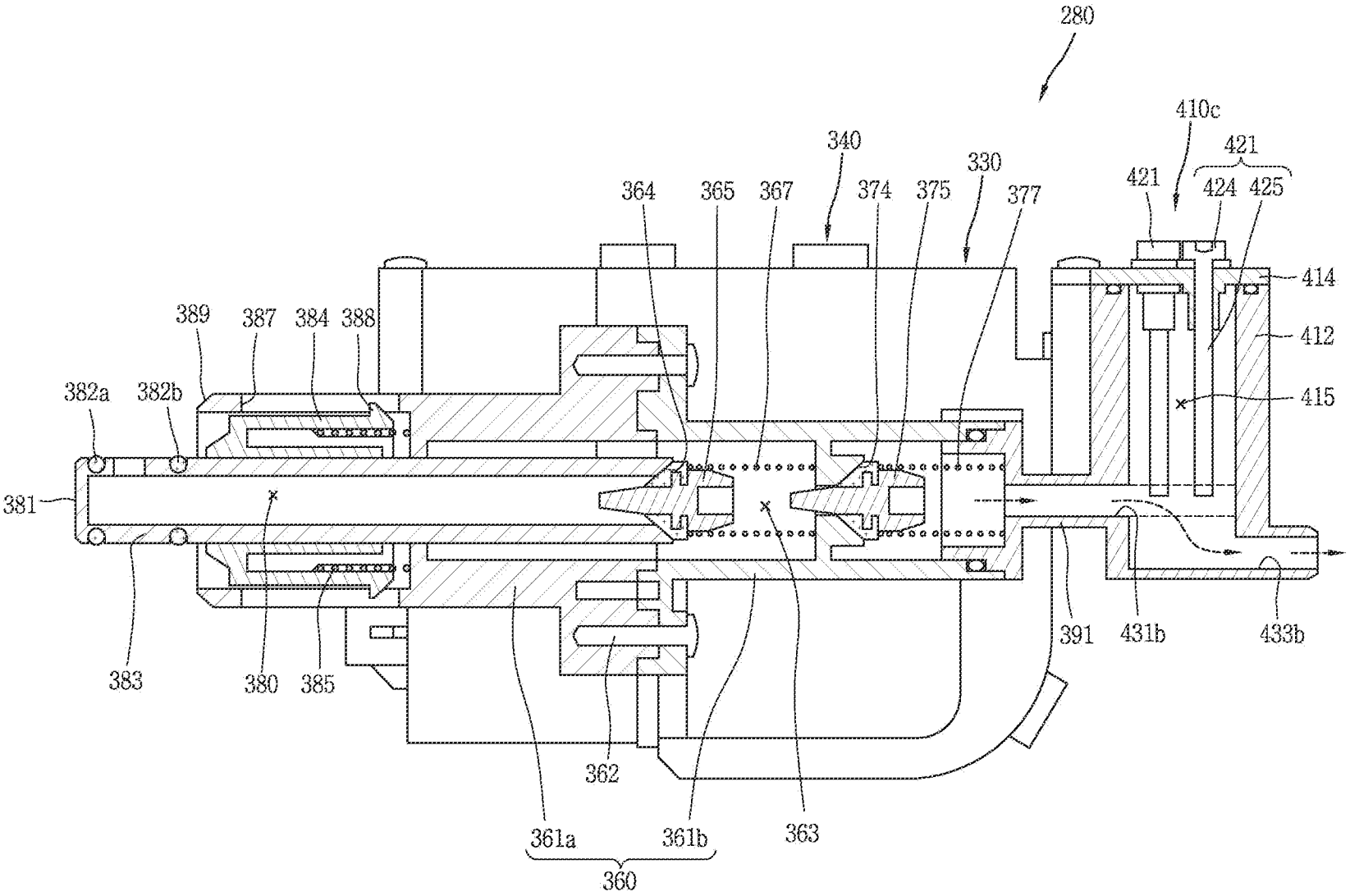
FIG. 12 is a view illustrating a variation of the washing agent pump of FIG. 10.

Meanwhile, a residual quantity detecting unit 410*c* according to another embodiment of the present disclosure, for example, as illustrated in FIG. 12, may include an air pocket forming portion 412 that forms an air pocket 415 therein and having an upper opening, and an air pocket cover 414 for closing the upper end of the air pocket forming portion 412. Here, an introduction portion 431*b* and a discharge portion 433*b* may be formed through the air pocket forming portion 412 in a manner of having a height difference. The air pocket cover 414 may be provided with a pair of electrodes 421 disposed within the air pocket forming portion 412 in up and down directions.

The introduction portion 431*b* may be upwardly spaced apart from a bottom surface of the air pocket 415 to have a preset height from the bottom surface. The discharge portion 433*b* may have a lower height than the introduction portion 431*b*. In more detail, an upper end (e.g., ceiling) of the discharge portion 433*b* may be disposed lower than a bottom of the introduction portion 431*b*. With this configuration, internal air of the air pocket 415 can be prevented from being discharged through the discharge portion 433*b*. Accordingly, a flow distribution of the liquid washing agent discharged through the discharge portion 433*b* may be reduced.

Each of the electrodes 421 may be disposed lower in height than the upper end of the introduction portion 431*b*. While the lower end of each electrode 421 is illustrated as being lower than the upper end of the introduction portion 431*b* and has the same height, this is merely illustrative. Alternatively, one of the electrodes 421 which has a high height may be disposed to be lower than the upper end of the introduction portion 431*b*.

Moreover, the upper end of the discharge portion 433*b* is disclosed as being disposed lower than a bottom portion of the introduction portion 431*b*. Alternatively, the upper end of the discharge portion 433*b* may have the same height as the bottom portion of the introduction portion 431*b*.

With this configuration, when the piston 320 starts to reciprocate in response to rotation of the electric motor 442, the intake valve 365 and the discharge valve 375 may operate in an alternating manner, such that the liquid washing agent is introduced into the pressing space 363 and then discharged into the introduction portion 391. The liquid washing agent discharged into the introduction portion 391 may then be introduced into the air pocket 415 through the introduction portion 431*b*, and then discharged through the discharge portion 433*b* to be introduced into the bellows connecting portion 167.

When the supply of the liquid washing agent is completed, the residual quantity detecting unit may detect the residual quantity of the liquid washing agent. Air may be stored in a compressed state in the air pocket 415 during the flow of the liquid washing agent, thereby preventing bubbles generated during the flow of the liquid washing agent from flowing up along the electrodes 421. Accordingly, an incorrect detection of the residual quantity due to the upward flow of the bubbles of the liquid washing agent can be prevented, thereby improving reliability of detection. When the supply of the liquid washing agent is completed, the electrodes 421 may detect the residual quantity of the liquid washing agent remaining in the lower portion of the air pocket 415.

Here, the air is stored in the air pocket in the compressed state during the flow of the liquid washing agent, and thus the bubbles generated during the flow of the liquid washing agent can be prevented from flowing up along the electrode 421. Accordingly, when a shortage of the residual quantity of the liquid washing agent within the lower portion of the air pocket 415 actually occurs, the bubbles may flow up and simultaneously be brought into contact with the pair of electrodes 421, thereby preventing the incorrect detection of the residual quantity of the liquid washing agent.

As described above, according to one embodiment of the present disclosure, a washing agent pump that supplies a liquid washing agent can be provided with a residual quantity detecting unit so as to facilitate a storage container to store the liquid washing agent to be drawn out without a separate residual quantity detecting means in the storage container.

Also, a residual quantity detecting unit can be provided therein with an air pocket in which air is accommodated, thereby effectively preventing an incorrect detection of the residual quantity of the liquid washing agent, which is caused due to bubbles generated during a flow of the liquid washing agent.

In addition, a residual quantity detecting unit may have a discharge portion that is lower than a bottom portion of an introduction portion. This may allow for preventing the air within the air pocket from being discharged simultaneously with the liquid washing agent, thereby preventing incorrect detection of the residual quantity caused due to the bubbles and reducing a difference in a supply quantity of the liquid washing agent due to introduction of air.

Therefore, an aspect of the detailed description is to provide a washing agent pump capable of facilitating a storage container to be drawn out without employing a detecting unit for detecting a residual quantity of liquid washing agent in the storage container, and a laundry treating apparatus having the same.

Another aspect of the detailed description is to provide a washing agent pump capable of preventing an incorrect detection of a residual quantity of a liquid washing agent, caused due to bubbles generated during a flow of a liquid washing agent, and a laundry treating apparatus having the same.

Another aspect of the detailed description is to provide a washing agent pump capable of preventing an incorrect detection of a residual quantity of a liquid washing agent, and reducing a deviation of a supply quantity of the liquid washing agent, and a laundry treating apparatus having the same.

To achieve these and other advantages and in accordance with the purpose of this specification, as embodied and broadly described herein, there is provided a laundry treating apparatus, which may include a cabinet, a tub provided within the cabinet, a rotary tub provided within the tub in a rotatable manner, and a washing agent supply unit provided with a storage container storing therein a liquid washing agent including liquid detergent or liquid softener (softening agent) and drawn out of the cabinet, a washing agent supply passage having one side connected to the storage container and another side connected to the tub, and a washing agent deliver member provided in the washing agent supply passage to deliver the liquid washing agent.

The washing agent deliver member may be a washing agent pump. The washing agent pump may include a passage forming member forming a passage of the liquid washing agent and the pressing space, and provided with an intake valve opening and closing an inlet port of the pressing space, and a discharge valve opening and closing an outlet port of the pressing space, a cylinder disposed at one side of the passage forming member to communicate with the pressing space, a piston disposed within the cylinder in a reciprocating manner, and a residual quantity detecting unit provided with an air pocket communicating with the passage of the passage forming member and temporarily storing therein air and the liquid washing agent, and electrodes disposed within the air pocket to be contactable with the liquid washing agent, the residual quantity detecting unit detecting the residual quantity of the liquid washing agent.

The washing agent supply passage for supplying the liquid washing agent may be provided between the washing agent pump and the tub. The residual quantity detecting unit may be disposed at a downstream side of the pressing space along a flowing direction of the liquid washing agent.

The air pocket may include an introduction portion through which the liquid washing agent is introduced and a discharge portion through which the liquid washing agent is discharged. The introduction portion and the discharge portion may be spaced apart from each other in the flowing direction of the liquid washing agent. The discharge portion may be located below the introduction portion.

An upper end of the discharge portion may be disposed at the same height as a bottom of the introduction portion. In one embodiment disclosed, the upper end of the discharge portion may be disposed lower than the bottom of the introduction portion.

The residual quantity detecting unit may be disposed at an upstream side of the pressing space along the flowing direction of the liquid washing agent. The passage forming member may be provided with an introduction space, which is disposed at the upstream side of the pressing space and in which the liquid washing agent is introduced.

A volume of the air pocket may be greater than that of the introduction space. The air pocket may upwardly protrude above the passage such that the liquid washing agent is temporarily accommodated in a lower portion of the air pocket and air is accommodated above the liquid washing agent. The volume of the air pocket may be greater by more than two times than the volume of the introduction space.

The apparatus may further include an intake valve spring and a discharge valve spring restoring the intake valve and the discharge valve to initial positions thereof, respectively. The apparatus may further include a piston operating unit operating the piston.

The introduction space may be provided with an introduction hole formed through a peripheral surface of the passage forming member, and further include an introduction hole opening/closing member opening and closing the introduction hole. The introduction hole opening/closing member may open and close the introduction hole while moving along a lengthwise direction of the passage forming member. An introduction hole opening/closing member spring may be provided to apply elastic force to the introduction hole opening/closing member in a direction of closing the introduction hole.

In accordance with another aspect of the present disclosure, a washing agent pump may include a passage forming member forming a passage of a liquid washing agent including liquid detergent or liquid softener, and a pressing space, and provided with an intake valve opening and closing an inlet port of the pressing space, and a discharge valve opening and closing an outlet port of the pressing space, a cylinder disposed at one side of the passage forming member to communicate with the pressing space, a piston disposed within the cylinder in a reciprocating manner, and a residual quantity detecting unit provided with an air pocket communicating with the passage of the passage forming member and temporarily accommodating therein air and the liquid washing agent, and electrodes disposed within the air pocket to be contactable with the liquid washing agent, the residual quantity detecting unit detecting the residual quantity of the liquid washing agent.

The washing agent pump may further include a piston operating unit operating the piston to reciprocate. Moreover, the residual quantity detecting unit may be disposed at a downstream side of the pressing space along a flowing direction of the liquid washing agent.

The air pocket may include an introduction portion through which the liquid washing agent is introduced and a discharge portion through which the liquid washing agent is discharged. The introduction portion and the discharge portion may be spaced apart from each other in the flowing direction of the liquid washing agent, and the discharge portion may be located below the introduction portion. In one embodiment, an upper end of the discharge portion may be disposed at the same height as a bottom of the introduction portion or lower than the bottom of the introduction portion.

The passage forming member may be provided with an introduction space, which is disposed at an upstream side of the pressing space and in which the introduction space storing the liquid washing agent introduced. The residual quantity detecting unit may be disposed at the upstream side of the pressing space along the flowing direction of the liquid washing agent to communicate with the introduction space. A volume of the air pocket may be greater than a volume of the introduction space. The intake valve may be disposed within the pressing space and the discharge valve may be disposed outside the pressing space. The washing agent pump may further include an intake valve spring and a discharge valve spring restoring the intake valve and the discharge valve to initial positions thereof, respectively.

In accordance with another aspect of the present invention, a washing agent pump may include a cylinder that sucks and discharges a liquid washing agent including liquid detergent or liquid softener, a piston reciprocating within the cylinder, and a residual quantity detecting unit provided with an air pocket communicating with an intake-side passage or a discharge-side passage of the liquid washing agent of the cylinder and temporarily accommodating therein air and the liquid washing agent, and electrodes disposed within the air pocket to be contactable with the liquid washing agent, the residual quantity detecting unit detecting the residual quantity of the liquid washing agent.

The washing agent pump may further include a passage forming member forming the passage of the liquid washing agent and a pressing space, and provided with an intake valve opening and closing an inlet port of the pressing space, and a discharge valve opening and closing an outlet port of the pressing space, the passage forming member disposed to communicate the pressing space and an inside of the cylinder with each other.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A laundry treating apparatus, comprising:
a cabinet;
a tub to be within the cabinet;
a rotary tub to be within the tub; and
a washing agent supply unit configured to provide a washing agent for the tub;
wherein the washing agent supply unit comprises:
a storage container located in the cabinet, and storing the washing agent; and
a washing agent pump connected to the storage container,
wherein the washing agent pump comprises:
a passage forming member to provide a passage including an introduction space, a pressing space, and a discharge space for the washing agent;
an intake valve disposed between the introduction space and the pressing space, the intake valve allowing a flow of the washing agent from the introduction space to the pressing space and restricting a flow of the washing agent from the pressing space to the introduction space; and
a discharge valve disposed between the pressing space and the discharge space, the discharge valve allowing a flow of the washing agent from the pressing space to the discharge space and restricting a flow of the washing agent from the discharge space to the pressing space,
wherein the storage container is communicated with the introduction space of the passage forming member, and the passage forming member is configured to discharge the washing agent of the discharge space, and
wherein the passage forming member is configured to align the introduction space, the pressing space, and the discharge space along a straight line.

2. The laundry treating apparatus of claim 1, wherein the washing agent pump comprises:
a cylinder to provide an inner space configured to communicate with the pressing space; and
a piston configured to move in a linear reciprocating motion within the cylinder and change volume of the inner space.

3. The laundry treating apparatus of claim 2, wherein:
a direction of the linear reciprocating motion of the piston is parallel to the straight line that aligns the introduction space, the pressing space, and the discharge space.

4. The laundry treating apparatus of claim 2, wherein:
an axis of the linear reciprocating motion of the piston is parallel to the straight line that aligns the introduction space, the pressing space, and the discharge space.

5. The laundry treating apparatus of claim 2, wherein the washing agent pump comprises:
a piston operating unit configured to control operation of the piston; and
a case to accommodate the piston operating unit,
wherein the case is to couple to a lateral surface of the passage forming member.

6. The laundry treating apparatus of claim 5, wherein the piston operating unit comprises:

an electric motor having a rotation shaft to provide a rotational motion; and a driving force transferring portion configured to convert the rotational motion into the linear reciprocating motion of the piston, and wherein the driving force transferring portion comprises:

a driving gear disposed on the rotation shaft of the electric motor;

a driving force transfer gear to engage with the driving gear;

a driven gear to engage with the driving force transfer gear and to rotate based on a driving force from the electric motor;

a crankshaft having a rotating shaft provided at the driven gear, and to rotate integrally with the driven gear; and a piston rod having a first end to couple to the piston and a second end to couple to the crankshaft.

7. The laundry treating apparatus of claim 6, wherein:

the rotation shaft of the electric motor is disposed toward a rear of the washing agent pump, and the piston is disposed toward a front of the washing agent pump.

8. A laundry treating apparatus, comprising:

a cabinet;

a tub to be within the cabinet;

a rotary tub to be within the tub; and a washing agent supply unit configured to provide a washing agent for the tub;

wherein the washing agent supply unit comprises:

a storage container to be within the cabinet, and configured to store the washing agent; and a washing agent pump to couple to the storage container, and configured to communicate with the storage container, wherein the washing agent pump comprises:

a first pipe portion having a pressing space disposed therein, and the first pipe portion to have a first inner diameter;

a second pipe portion having a second outer diameter smaller than the first inner diameter of the first pipe portion, and the second pipe portion to have a first end to be accommodated in the storage container and a second end to be accommodated in the first pipe portion;

a cylinder to provide an inner space;

a piston configured to move in a linear reciprocating motion within the cylinder and change volume of the inner space; and a communication passage configured to provide communication between the pressing space and the inner space at an overlapped position of the first pipe portion and the second pipe portion.

9. The laundry treating apparatus of claim 8, wherein:

the inner space is disposed more forward than the pressing space.

10. The laundry treating apparatus of claim 9, wherein:

the communication passage is configured to guide the washing agent accommodated in the pressing space to the inner space.

11. The laundry treating apparatus of claim 8, comprising:

a second body to provide the first pipe portion and a portion of the second pipe portion; and a first body to provide a remainder of the first pipe portion.

12. The laundry treating apparatus of claim 8, wherein:

a closed surface is provided at an end of the first pipe portion that accommodates the second pipe portion.

13. The laundry treating apparatus of claim 8, wherein:

an introduction space is within the second pipe portion, and the washing agent pump comprises:

an intake valve provided at the second end of the second pipe portion, and configured to control a flow of the washing agent from the introduction space to the pressing space; and a discharge valve provided within the first pipe portion, provided downstream of the pressing space, and configured to control the discharge of the washing agent from the pressing space.

14. The laundry treating apparatus of claim 8, wherein the washing agent pump comprises:

a piston operating unit configured to control operation of the piston; and a case to accommodate the piston operating unit, wherein the case is to couple to a lateral surface of a passage forming member including the first pipe portion and the second pipe portion.

15. The laundry treating apparatus of claim 14, wherein the piston operating unit comprises:

an electric motor having a rotation shaft to provide a rotational motion; and a driving force transferring portion configured to convert the rotational motion into the linear reciprocating motion of the piston, and wherein the driving force transferring portion comprises:

a driving gear disposed on the rotation shaft of the electric motor;

a driving force transfer gear to engage with the driving gear;

a driven gear to engage with the driving force transfer gear and to rotate based on a driving force from the electric motor;

a crankshaft having a rotating shaft provided at the driven gear, and to rotate integrally with the driven gear; and a piston rod having a first end to couple to the piston and a second end to couple to the crankshaft.

16. A laundry treating apparatus, comprising:

a cabinet;

a tub to be within the cabinet;

a rotary tub to be within the tub; and a washing agent supply unit configured to deliver a washing agent for the tub;

wherein the washing agent supply unit comprises:

a storage container to be within the cabinet, and configured to store the washing agent;

a washing agent pump to couple to the storage container, and configured to communicate with the storage container, wherein the washing agent pump comprises:

a piston configured to move in a linear reciprocating motion;

a piston operating unit configured to provide a driving force to operate the piston;

a case to provide an internal accommodating space for accommodating the piston operating unit;

a first cylinder to protrude from the case in a first direction, and configured to accommodate the piston;

a passage forming member to provide a passage for the washing agent and provide at least a pressing space within the passage forming member; and a second cylinder to be formed integrally with the passage forming member, and configured to provide an inner space to communicate with the pressing space, and having an opening formed in a second direction opposite to the first direction, and accommodating the first cylinder, and wherein the first cylinder is inserted into the second cylinder through the opening of the second cylinder to couple with the second cylinder.

17. The laundry treating apparatus of claim 16, wherein:

a length of the second cylinder is longer than a length of the first cylinder.

18. The laundry treating apparatus of claim 17, wherein the passage forming member comprises:

a second body, at least a portion of which is disposed at a forward area of the washing agent pump; and a first body to couple to a rear side of the second body, and wherein the second cylinder is to protrude from the first body.

19. The laundry treating apparatus of claim 16, wherein a surface of the case is to couple to a lateral surface of the passage forming member.

20. The laundry treating apparatus of claim 19, wherein the piston operating unit comprises:

an electric motor having a rotation shaft to provide a rotational motion; and a driving force transferring portion configured to convert the rotational motion into the linear reciprocating motion of the piston, and wherein the driving force transferring portion comprises:

a driving gear disposed on the rotation shaft of the electric motor;

a driving force transfer gear to engage with the driving gear;

a driven gear to engage with the driving force transfer gear and to rotate based on a driving force from the electric motor;

a crankshaft having a rotating shaft provided at the driven gear, and to rotate integrally with the driven gear; and a piston rod having a first end to couple to the piston and a second end to couple to the crankshaft.

21. The laundry treating apparatus of claim 16, wherein the washing agent pump includes a residual quantity detecting unit provided with an air pocket cavity in communication with the passage forming member.

* * * * *